United States Patent [19]

Arai et al.

[11] Patent Number: 4,805,348

[45] Date of Patent: Feb. 21, 1989

[54] FLAT LAPPING MACHINE

[75] Inventors: Hatsuyuki Arai, Zama; Isao Nagahashi, Fujisawa; Seiichi Maeda, Ayase; Kazumi Yasuda, Zama; Shiro Furusawa, Fujisawa; Kazuhiko Hirata, Sagamihara; Kastunori Nagao, Ayase; Kazuhiko Kondo, Atsugi; Takaya Sanoki, Ebina; Misuo Sugiyama, Hadano; Shinichi Kusano, Yamato, all of Japan

[73] Assignee: Speedfam Co., Ltd., Japan

[21] Appl. No.: 891,241

[22] Filed: Jul. 29, 1986

[30] Foreign Application Priority Data

| | | | |
|---|---|---|---|
| Jul. 31, 1985 | [JP] | Japan | 60-117510[U] |
| Jul. 31, 1985 | [JP] | Japan | 60-117509[U] |
| Feb. 13, 1986 | [JP] | Japan | 61-29705 |
| Feb. 18, 1986 | [JP] | Japan | 61-33378 |

[51] Int. Cl.[4] ..... B24B 7/00

[52] U.S. Cl. ..... 51/118; 51/131.3

[58] Field of Search ..... 51/118, 119, 120, 131.3, 51/131.2, 131.1, 133

[56] References Cited

U.S. PATENT DOCUMENTS 2,618,911 11/1952 Indge ..... 51/131.3

FOREIGN PATENT DOCUMENTS 0157035 12/1981 Japan ..... 51/131.3

0157036 12/1981 Japan ..... 51/131.3

*Primary Examiner*—Frederick R. Schmidt

*Assistant Examiner*—Robert A. Rose

*Attorney, Agent, or Firm*—Charles F. Pigott, Jr.; Garrettson Ellis

[57] ABSTRACT

Described herein is a flat lapping machine capable of precision-abrading simultaneously flat surfaces on the front and rear sides of a work in the fashion of lapping, polishing and grinding machines. The present invention contemplates to provide a flat lapping machine which is simplified in construction as compared with conventional flap lapping machines having a large number of carriers in planetary motions, and which can stop the respective carriers easily in specific positions and directions at the end of a lapping operation. To this end, the present invention employs a large number of support gear mechanisms each constituted by a plural number of small gears and located at uniform intervals around a center gear, rotatably supporting the respective carriers in predetermined positions while the respective carriers are driven by the center gear.

16 Claims, 5 Drawing Sheets

FLAT LAPPING MACHINE

<FIELD OF THE INVENTION>

This invention relates to a flat lapping machine for precision-abrading flat surfaces on the front and rear sides of a work in the fashion of a lapping, polishing or grinding machine.

<STATE OF THE ART>

For lapping works such as semiconductor wafers and substrates of computer memory disks, there has been known in the art a lapping machine employing a large number of carriers which are meshed with and put in planetary motions between a rotatable sun gear and an internal gear, lapping by upper and lower lapping plates a plural number of works retained on each carrier. The conventional lapping machine of such an arrangement has a number of inherent drawbacks as follows.

(a) The arrangement of driving the carriers by both the sun gear and internal gear necessitates to employ an internal gear of a large diameter and a drive mechanism of complicated construction. Besides, the control of rotation of the carriers is complicated and troublesome since both of the center gear and internal gear have to be controlled in order to change the direction of rotation of the carriers in a lapping operation.

(b) It is difficult to load and unload the carriers and works to and from the lapping machine automatically.

Namely, for automation of these operations, it is necessary to ensure that the respective carriers be located in predetermined positional relationship with each other, and stopped exactly in predetermined loading and unloading positions before and after a lapping operation, retaining works constantly in predetermined positions by the carriers.

However, the above-mentioned conventional flat lapping machine has the respective carriers meshed with a common internal gear of a large diameter, so that it is relatively difficult to locate them constantly and independently in predetermined positions. In addition, since each one of the carriers is put in planetary motion around a sun gear, it is extremely difficult to stop them in particular specified positions at the end of a lapping operation and to regulate the directions of the entire carriers in such a manner that a plural number of works are located constantly in predetermined positions.

(c) When lifting up an upper plate upon completion of a lapping operation, works often tend to stick on and float up with the lifted upper plate or suffer from damages by falling in the middle of the upward movement. Further, it is difficult to impart to the works an abrading pattern in a particular direction.

The firstly mentioned problem can be solved by restraining works on the carriers by suitable means upon completion of a lapping operation, while the second problem can be solved by performing the lapping operation in a short time period while holding the works in restrained state on the carriers. However, in order to restrain all of the works on the carriers, it is necessary to stop the respective carriers and works regularly in predetermined directions at the end of a lapping operation as mentioned hereinbefore.

<SUMMARY OF THE INVENTION>

It is an object of the present invention to provide a flat lapping machine of a simplified construction. Obviating to mesh the respective carriers commonly with an internal gear of a large diameter and instead driving the respective carriers by means of a single drive gear.

It is another object of the present invention to provide a flat lapping machine which can hold the respective carriers in predetermined positional relationship with each other and can easily stop them regularly in predetermined positions and directions upon completion of a lapping operation.

In order to solve the above-mentioned problems, the flat lapping machine of the invention comprises a multitude of support gear mechanisms each constituted by a plural number of small gears and located at uniform intervals around a center gear, rotatably supporting the carriers in predetermined positions by the respective support gear mechanisms while driving the carriers by the center gear.

The works which are retained on the respective carriers, each supported by the small gears of a support gear mechanism, are lapped by upper and lower lapping plates as the carriers are rotated in predetermined positions by rotation of the center gear and the upper and lower plates. By reversing the rotational direction of the center gear and upper and lower lapping plates, the works can be abraded uniformly, and flatness of the lapping plates can be controlled suitably.

Since the respective carriers are driven solely by the center gear without using a large internal gear as required by the conventional machines, the drive system can be simplified. Besides, it can be controlled in a facilitated manner as there is no necessity for controlling both of the center and internal gears at the time of changing the rotational direction of the carriers during lapping operations.

As soon as the lapping of works is completed, the rotations of the center gear and the upper and lower plates are stopped. The respective carriers are driven in predetermined positions by the common center gear, so that they can be easily stopped regularly in a specific direction. Accordingly, the carriers and works can be loaded and unloaded easily by automatic operations. In addition, in case the carriers are provided with restraining means, the works can be restrained in the respective carriers by a simple operation.

The above and other objects, features and advantages of the invention will become apparent from the following description and the appended claims, taken in conjunction with the accompanying drawings which show by way of example some preferred embodiments of the invention.

<DESCRIPTION OF PREFERRED EMBODIMENTS>

Figure 1:
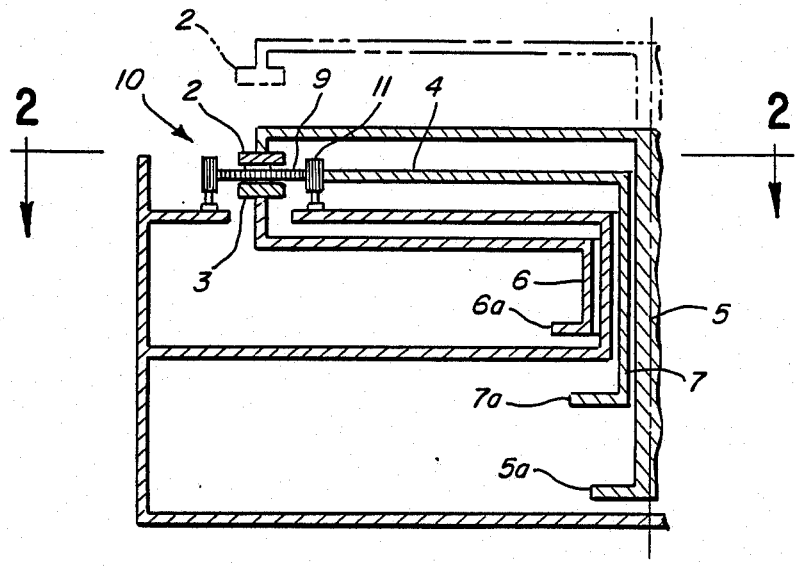
FIG. 1 is a vertically sectioned view of part of a flat lapping machine embodying the present invention.
Figure 2:
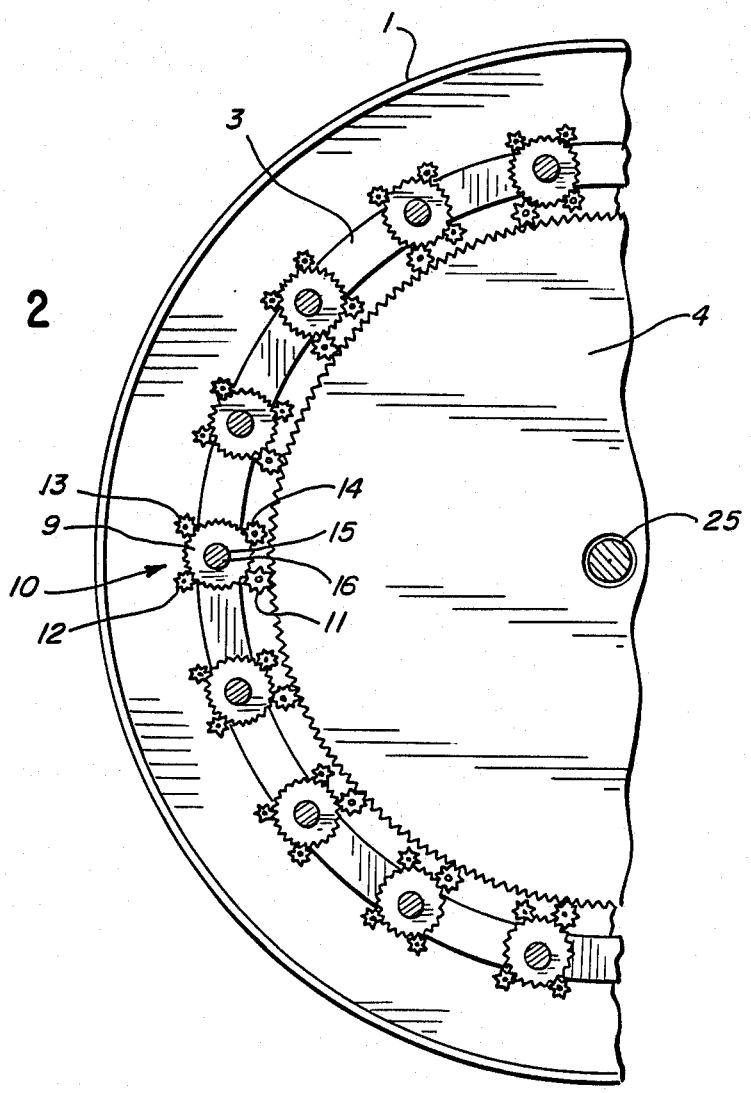
FIG. 2 is a sectional view of the part shown in FIG. 1 taken along 2—2 of FIG. 1.

Hereafter, the invention is described in detail by way of the preferred embodiments shown in the drawings. Referring to FIGS. 1 and 2, indicated at 1 is a machine frame of the flat lapping machine, at 2 and 3 are upper and lower lapping plates, and at 4 is a center gear. The lapping plates 2 and 3 and center gear 4 are connected to a drive source, not shown, through sprockets 5*a*, 6*a* and 7*a* which are mounted at the lower ends of coaxial drive shafts 5 to 7, respectively, to rotate them at an arbitrary speed and in an arbitrary direction. As inciated in phantom in FIG. 1, the upper plate 2 is vertically movably supported on the drive shaft 5.

Figure 3:
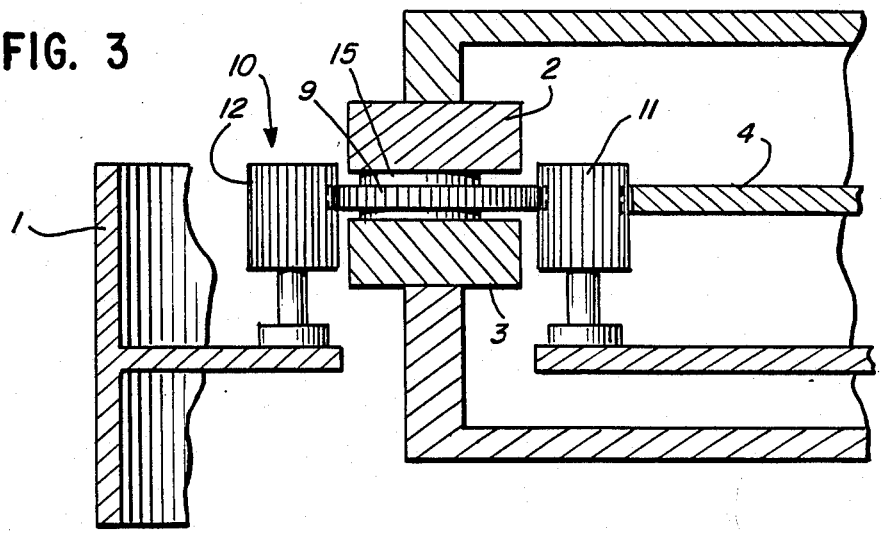
FIG. 3 is a vertical section showing part of the flat lapping machine of FIG. 1 on an enlarged scale.
Figure 4:
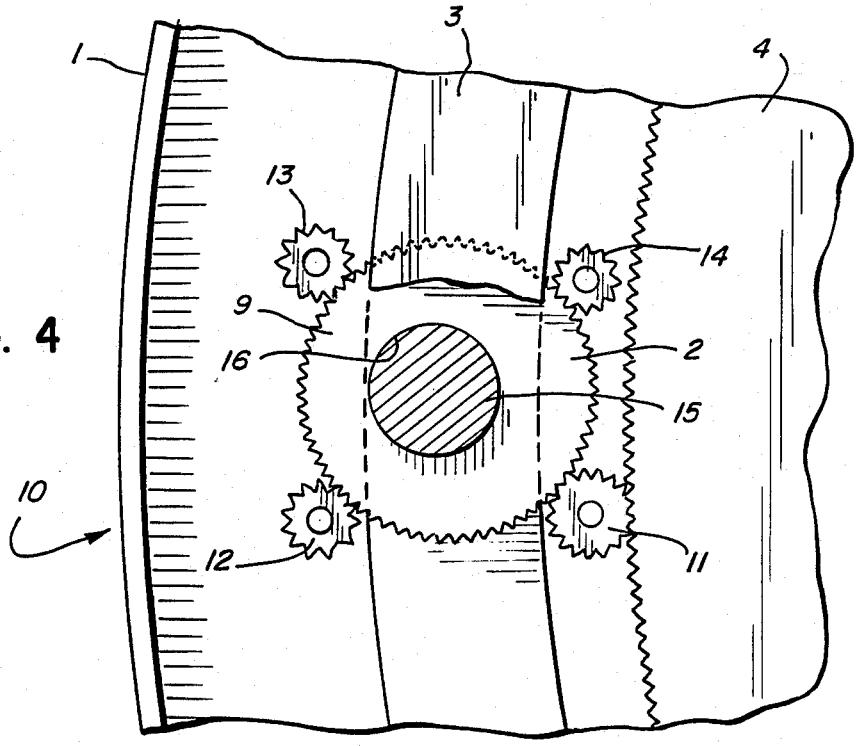
FIG. 4 is a plan view of the part shown in FIG. 3.

Mounted on the machine frame 1 are a multitude of carrier support gear mechanisms 10 which are located at uniform intervals about the center gear 4. These support gear mechanisms 10 rotatably support the respective carriers 9 in predetermined positions. As clear from FIGS. 3 and 4, the support gear mechanism 10 consists of a plural number of small gears 11 to 14 which are located circularly in spaced positions around and in engagement with a carrier 9. One of the small gears 11 to 14, for example, the small gear 11 is also in engagement with the center gear 4 to constitute a small drive gear through which the carrier 9 is driven from the center gear 4. Of the remaining small gears 12 to 14, the small gear 14 which is located on the side of the center gear 4 is formed in a smaller diameter than other small gears to prevent its contact with the center gear 4.

The carrier 9 which is supported by the above-described support gear mechanism 10 retains therein a work 15 to be lapped by the upper and lower plates 2 and 3, holding the work in a work retaining pocket 16 which is formed in an eccentric position. In a lapping operation, the work 15 which is retained in the work retaining pocket 16 is turned along a circle having a radius corresponding to the eccentric distance.

In order to lap works 15 by the flat lapping machine with the above-described construction, firstly works 15 are put in the work holders of the carriers 9 which are in engagement with the small gears 11 to 14 of the respective support gear mechanisms as shown particularly in FIG. 2. At this time, the carriers 9 are set in such positions that the respective eccentric work holders 16 are positioned on the same side with respect to the center of the center gear 4. Nextly, after lowering the upper lapping plate 2 to the position indicated by solid line in FIG. 1, the center gear 4 is rotated in one direction at a constant speed, and the upper and lower lapping plates 2 and 3 are rotated in opposite directions at uniform speeds. As a result, each carrier 9 is supported in a predetermined position and rotated by the small drive gear 11, and the work in its eccentric work holder 16 is turned around a circle having a radius corresponding to the eccentric distance as it is lapped by the upper and lower plates 2 and 3.

After lapping for a predetermined time period, the rotation of the center gear is reversed to rotate the carriers 9 in the opposite direction, thereby reversing the rotation of the works 15, namely, the direction of sliding contact of the works 15 with the lapping plates 2 and 3. This prevents localized abrasion which would occur due to the difference in speed between the inner and outer peripheral portions of the lapping plates 2 and 3 when the works are rotated only in one direction, suitably maintaining the flatness of the plates 2 and 3 and facilitating their maintenance to a considerable degree.

As soon as the lapping of the works 15 is completed, the center gear 4 and the upper and lower lapping plates 2 and 3 are stopped, and then the upper lapping plate 2 is lifted up to the position indicated in phantom in FIG. 1 to unload the works 9 from the carriers 9. The works 15 may be unloaded separately from or together with the carriers 9. Since the carrier are maintained constantly in predetermined positions without revolving around the center gear 4 and, since the respective carriers 9 lie in the same direction with respect to the center of the center gear 4, they can be stopped in the same direction easily by the use of a suitable detecting means which is adapted to detect the rotational angle of the center gear 4 and to stop same at a certain predetermined rotational angle. Accordingly, loading and unloading of the carriers 9 and works 15 can be faciliated to a marked degree. Especially, automation of the work loading and unloading operations can be realized easily since there is no necessity for adjusting each time the positions and directions of the carriers.

For instance, as a means for detecting the rotational position of the center gear 4 and stopping same in a predetermined position, there may be employed a center gear 4 which is formed with n (integer) times greater number of teeth than the carriers 9 and which is provided with an n-number of dogs (not shown) thereon or on its drive shaft 7 at uniform intervals for cooperation with a dog detector which is mounted oppositely in a suitable position on the machine frame 1. The carriers 9 can be turned off regularly in a predetermined direction by stopping the center gear 4 at a predetermined angular position through the dog detection.

Figure 5:
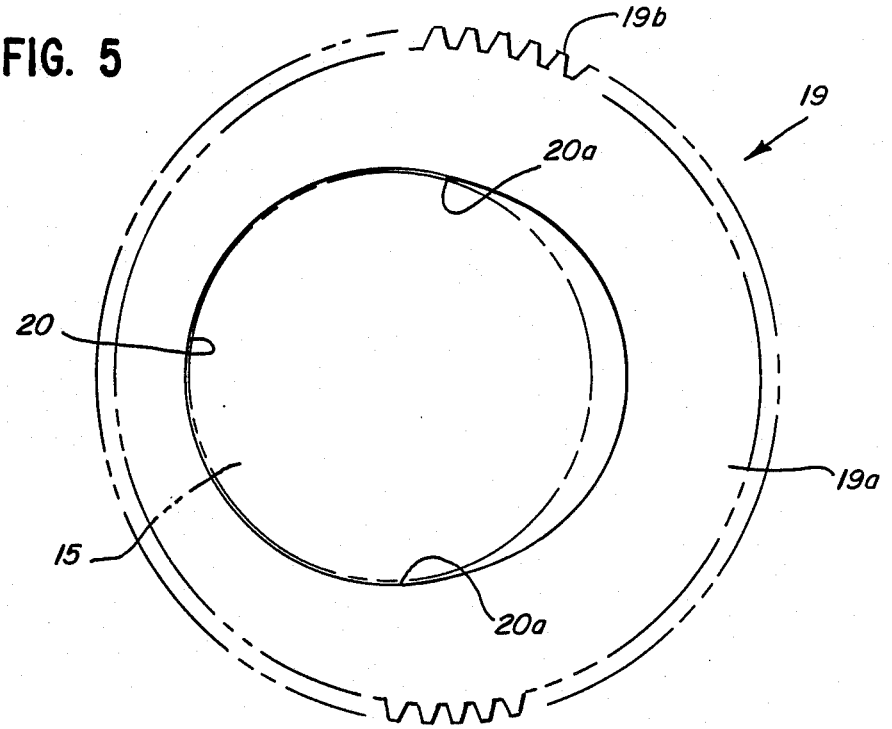
FIG. 5 is a plan view of a carrier with a restraining means.
Figure 6:
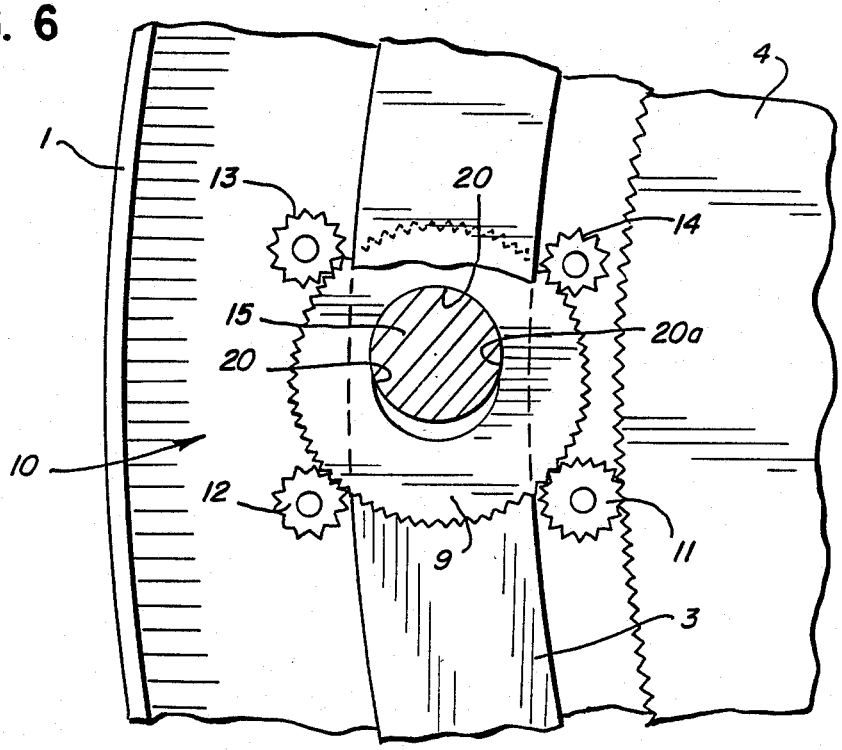
FIG. 6 is a fragmentary plan view of the carrier in operation.

Although carriers 9 with circular work retaining pockets are used in the above-described embodiment, it is preferable to employ carriers with work restraining means as shown in FIGS. 5 and 6 for the purpose of preventing works 15 from floating up with the upper lapping plate 2 when the latter is lifted up.

Illustrated in FIG. 5 is a carrier 19 which is provided with a gear 19*b* around the circumference of its body 19*a* with a work retaining pocket 20 in an eccentric position The work retaining hole 20 is provided with a work restraining means constituted by tapered portions 20*a* which are formed in part of the work retaining pocket 20 to hold a work 15 therein in a restrained state.

More particularly, the work 15 on the carrier 19 is held in a restrained state in the following manner. Upon completion of a lapping operation, the upper and lower lapping plates 2 and 3 and the center gear 4 are stopped as shown in FIG. 6, stopping the carriers 19 in such positions that the tapered portions 20*a* of the respective work retaining pocket 20 lie in the circumferential direction of the plates 2 and 3.

In this state, holding the center gear 4 stationary, the upper and lower lapping plates 2 and 3 are turned toward the tapered portions 20*a*, so that the works 15 are pushed into the tapered portions 20*a* and retained in restrained state while an abrading pattern of one direction is imparted to the work surfaces. Formation of the abrading pattern improves the appearance of products and enhances their commercial values.

In the next place, the upper lapping plate 2 is lifted up to remove the works 15. At this time, the works which are held in restrained state by the tapered portions 20*a* are prevented from being floated up with the lifted lapping plate 2.

Figure 7:
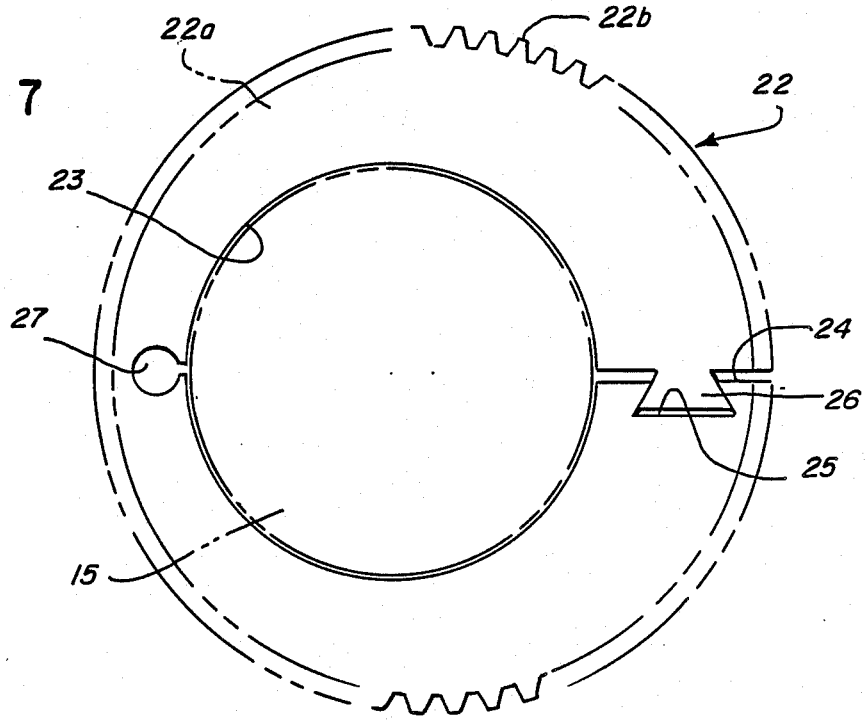
FIG. 7 is a plan view showing another example of the carrier with a restraining means.

Illustrated in FIG. 7 is a carrier 22 which is provided with a gear 22*b* around the circumference of its body 22*a* and formed with a work retaining pocket 23 in an eccentric position. The carrier body 22*a* is provided with a transverse split groove 24 at one side, which joins at its inner end with the work retaining pocket 23. The opposing edges of the slit 24 are in the form of a dovetail groove 25 and a dovetail projection 26, respectively. The dovetail groove 25 has slightly greater dimensions than the dovetail projection 26 to permit elastic deformation of the carrier body 22*a* within a range in which the dovetail projection 26 is displaceable within the dovetail groove 25. By this elastic deformation of the carrier body 22*a*, the work retaining pocket 23 is expanded or contracted to release or restrain the work 15 in the pocket. In this instance, a circular notch 27 is formed on the carrier body in a radially opposite position with respect to the split groove 24 to prevent cracking of the carrier body which may be caused by concentration of stress at that position as a result of the elastic deformation.

The lapping operation using the carriers 22 is as follows. As shown particularly in FIG. 8, all of the carriers 22 are mounted on the respective support gear mechanisms 10 in such a manner that they are supported in the same direction, and the center gear 4 is rotated in the direction of arrow a to lapp the works 15 which are retained on the carriers 22. During the lapping operation, unnecessary expansion of the carrriers 22 with the split groove 24 is prevented by engagement of the dovetail groove 25 and dovetail projection 26, which limit the expansion of the carriers 22 to an extremely small width which will not impair normal lapping operation.

Figure 8:
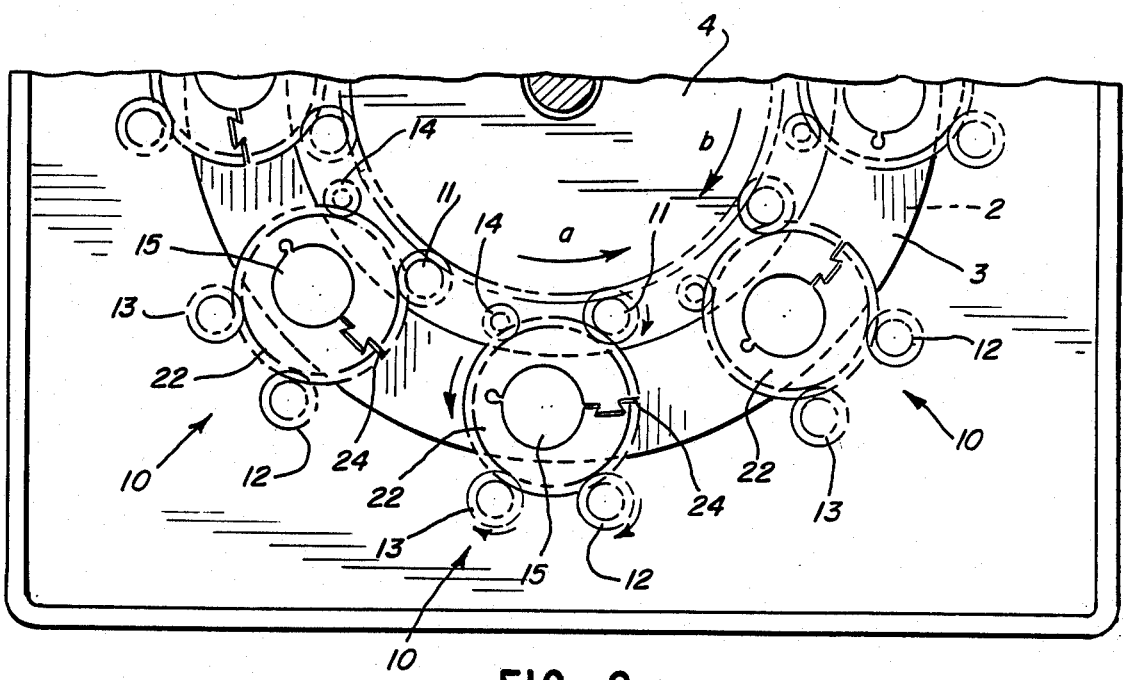
FIG. 8 is a fragmentary plan view of the carrier of FIG. 7 in operation.

On completion of a lapping operation, the upper and lower lapping plates 2 and 3 and the center gear 4 are stopped, and the carriers 22 are stopped in such positions that the respective split grooves 24 lie in the circumferential direction of the lapping plates 2 and 3 as shown particularly in FIG. 8.

In this state, the center gear 4 is rotated in the reverse direction as indicated by arrow b while holding at least one of the small gears 12 and 13 stationary, whereupon the carrier 22 undergoes elastic deformation to narrow the split groove 24, restraining the work 15 in position by contraction of the work retaining pocket 23.

Accordingly, it is necessary to use the carriers 22 in combination with support gear mechanisms 10 in which at least one of the small gears 12 and 13 can be braked against rotation in the reverse direction.

While the work 15 is held in a restrained state, not only an abrasion pattern can be imparted to the work surface by a lapping operation, but also the work 15 is prevented from being floated up with the upper lapping plate 2 as the latter is raised after the lapping operation, in a manner similar to the above-described embodiment.

The work 15 can be relieved of the restraining action simply by rotating the center gear 4 slightly in the direction of arrow a.

Figure 9:
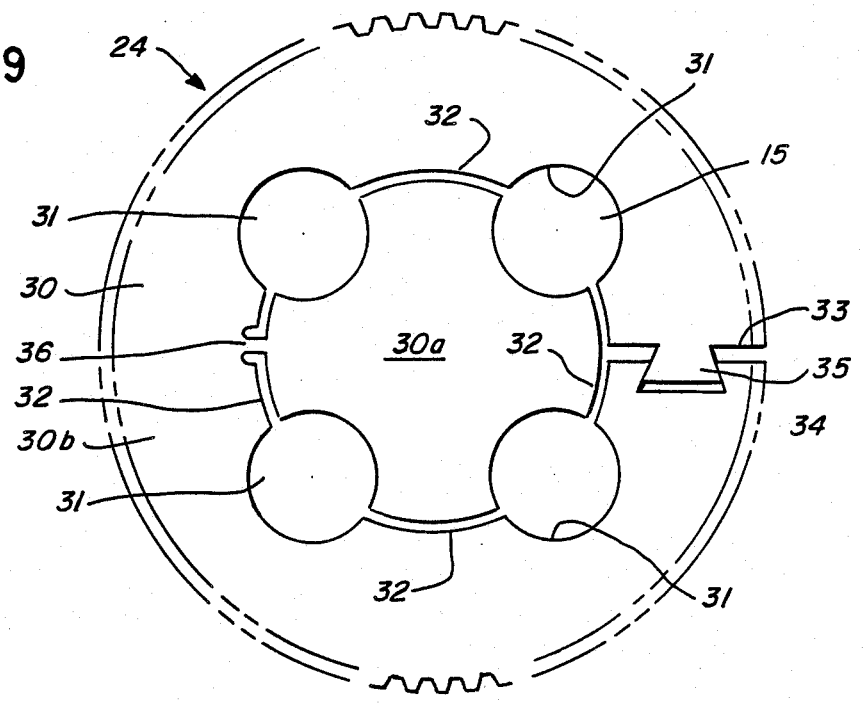
FIG. 9 is a plan view showing still another example of the carrier with a restraining means.

Shown in FIG. 9 is a carrier 30 which is provided with a plural number of work retaining pockets 31 formed on its body 30. These work retaining pockets 31 are successively connected by slit-like grooves 32, and a radial split groove 33 is extended and connected to one of the grooves 32. The opposing edges of the split groove 33 are engaged with each other through a dovetail groove 34 and a dovetail projection 35. The groove 32 which is located on the side remote from the split groove 33 is provided with a bridge portion 36 connecting an inner portion 30a, which is defined by the work retaining pockets 31 and grooves 32, with an outer portion 30*b* of the carrier body 30.

Since the lapping operation using the carrier 29 and the resulting effects same as in the above-described operation using the carrier 22, the description in this regard is omitted to avoid unnecessary repetitions.

Figure 10:
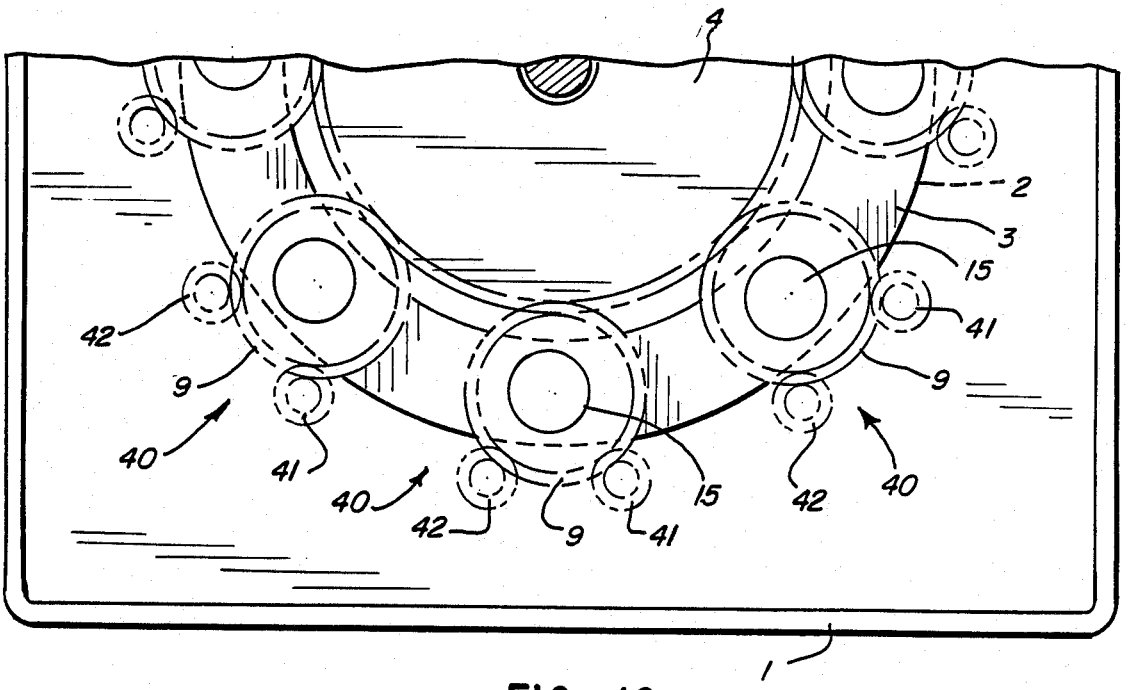
FIG. 10 is a plan view showing part of another embodiment of the flat lapping machine according to the present invention.

FIG. 10 illustrates a further embodiment of the lapping machine of the invention, which is substantially same as the embodiment of FIG. 1 except that each support gear mechanism 40 is constituted by a pair of small gears 41 and 42 and each one of the carriers 9 is meshed directly with the center gear 4. Therefore, works are lapped substantially in the same manner as in the embodiment of FIG. 1.

What is claimed is:

1. A flat lapping machine of the type including a plural number of carriers located around and driven by a center gear connected to a drive source, each carrier being capable of retaining a work thereon for lapping said work by upper and lower lapping plates, the improvement comprising, in combination:

a plural number of support gear mechanisms located around said center gear and each constituted by a plural number of small gears to support said carriers rotatably in predetermined positions, said carriers being meshed with said center gear through small gears of said support gear mechanisms, at least one small gear in meshing engagement wtih said center gear having a larger diameter than another of said small gears which serves to support said carrier but is free of engagement with said center gear.

2. The flat lapping machine according to claim 1, where in the number of teeth of said center gear correspond to the number of teeth of said carrier's gear as multiplied by an integer.

3. The flat lapping machine according to claim 1, including means for causing at least one of the small gears of said support gear mechanism to be held stationary while the center gear is rotated a short distance.

4. The flat lapping machine according to claim 1, wherein said carriers are each provided with an eccentrically positioned work retaining pocket.

5. The flat lapping machine according to claim 4, wherein said carriers are provided with restraining means for holding a work or works in restrained state in said work retaining pocket.

6. The flat lapping machine according to claim 5, wherein said restraining means is constituted by tapered portions provided in part of said work retaining pocket.

7. The flat lapping machine according to claim 5, wherein said restraining means is constituted by a radial groove formed contiguously on one side of said work retaining pocket, to cause said pocket to be at least partly defined by a split ring.

8. The flat lapping machine according to claim 7, including means for causing at least one of the small gears of said support gear mechanism to be held stationary while the center gear is rotated a short distance, whereby said restraining means can be activated and released as said one small gear is held stationary or not so held as the center gear is rotated.

9. A flat lapping machine of the type including a plural number of carriers located around and driven by a center gear connected to a drive source, each carrier being capable of retaining a work thereon for lapping said work by upper and lower lapping plates, the improvement comprising, in combination, a plurality of support gear mechanisms located around said center gear and each comprising a plural number of small gears surrounding each carrier and supporting each carrier rotatably in predetermined positions; each carrier being provided with at least one eccentrically positioned work retaining pocket, said carrier defining an essentially radial groove communicating with said work retaining pocket to cause said carrier to define a split ring, said split ring constituting releasable restraining means for holding a work in said work retaining pocket.

10. The flat lapping machine of claim 9, including means for causing at least one of said small gears of said support gear mechanism to be held stationary while the center gear is rotated a short distance, whereby said restraining means can be activated and released as said one small gear is held stationary or not so held as the center gear is rotated.

11. The flat lapping machine according to claim 10, wherein one of said small gears which support each carrier is in meshing engagement with said center gear and said small gear in meshing engagement has a larger diameter than another of said small gears supporting each carrier which is located on the side of said carrier facing said center gear but is free of engagement with said center gear.

12. The flat lapping machine of claim 11, in which the number of teeth of the center gear correspond to the number of teeth on the carrier, multiplied by an integer.

13. The flat lapping machine of claim 12, in which said carriers define gears which mesh directly with said center gear.

14. A flat lapping machine of the type including a plural number of carriers located around and driven by a center gear connected to a drive source, each carrier being capable of retaining a work thereon for lapping said work by upper and lower lapping plates, the improvement comprising, in combination:

a plural number of support gear mechanisms located in equidistant positions around said center gear and each constituted by a plural number of small gears to support said carriers rotatably in predetermined positions;

said carriers being each provided eccentrically with a single work retaining pocket having a contour, the contour of which is partly shaped by tapered portions as a work means for restraining the work.

15. The flat lapping machine according to claim 14;

wherein the number of teeth of said center gear correspond to the number of teeth of said carrier's gear as multiplied by an integer;

and said machine has a function such that each work is pushed against said tapered portions and restrainingly held by rotating the lapping plate toward the tapered portions while the central gear is stopped so that each tapered portion is positioned toward the circumferential direction of the lapping plate.

16. A flat lapping machine of the type including a plural number of carriers located around and driven by a center gear connected to a drive source, each carrier being capable of retaining a work thereon for lapping said work by upper and lower lapping plates, the improvement comprising, in combination:

a plural number of support gear mechanisms located around said center gear and each constituted by a plural number of small gears to support said carriers rotatably in predetermined positions, said carriers being meshed with said center gear through small gears of said support gear mechanisms, said carriers each being provided with an eccentrically positioned work retaining pocket, plus restraining means for holding a work or works in restrained state in said work retaining pocket wherein said restraining means is constituted by tapered portions provided in part of said work retaining pocket.

* * * * *